United States Patent [19]

Reitsma

[11] 4,099,058

[45] Jul. 4, 1978

[54] METHOD OF OPTIMIZING RADIATION DOSES IN AN X-RAY EXAMINING DEVICE, AND A DEVICE FOR PERFORMING THE METHOD

[75] Inventor: Hantje Reitsma, Eindhoven, Netherlands

[73] Assignee: U.S. Philips Corporation, New York, N.Y.

[21] Appl. No.: 759,713

[22] Filed: Jan. 17, 1977

[30] Foreign Application Priority Data

Jan. 23, 1976 [NL] Netherlands ..... 7600688

[51] Int. Cl.[2] ..... H05G 1/30

[52] U.S. Cl. ..... 250/416 TV

[58] Field of Search ..... 250/416 TV; 358/110, 358/111

[56] References Cited

U.S. PATENT DOCUMENTS 3,567,854 3/1971 Tschantz et al. ..... 250/416 TV X 3,602,641 8/1971 Heise ..... 250/416 TV X

*Primary Examiner*—Davis L. Willis

*Attorney, Agent, or Firm*—Frank R. Trifari; Jack E. Haken

[57] ABSTRACT

During the building up of a charge image in the anode layer of the pick-up tube, it is scanned frame-wise by an electron beam at increased cathode potential. As soon as the local quantity of charge exceeds a threshold value which is determined by the cathode potential, an anode current will occur when the relevant position is scanned. This anode current indicates that the illumination of the corresponding position has reached a desired level.

When the cathode voltage is varied during the scanning, a charge image can be scanned with a threshold value adapted to the various parts of the charge image. Underexposure and overexposure of a desired (important) part of the image to be realized are thus precluded.

6 Claims, 3 Drawing Figures

METHOD OF OPTIMIZING RADIATION DOSES IN AN X-RAY EXAMINING DEVICE, AND A DEVICE FOR PERFORMING THE METHOD

The invention relates to a method of optimizing an exposure time for producing a shadow image to be formed by X-radiation, the radiation ultimately causing, after having passed through the object, a charge image to be built up in a radiation-sensitive layer of an image pick-up tube, the said charge image being irradiated by electrons released from a cathode of the image pick-up tube, the cathode carrying an increased potential relative to an operating potential, the cathode potential being subsequently reduced to the operating potential after a signal current generated by the electrons has exceeded a threshold value, the building up of the charge image then being stopped. The invention furthermore relates to a device for using the method. A device in the form of an X-ray diagnostic apparatus in which a similar method is used is known, for example, from German Offenlegungsschrift No. 2,032,780. In this device a charge image or at least a part thereof, produced by X-rays, is irradiated by a defocussed electron beam. The signal current produced by the defocussed electron beam is used as an input quantity for exposure control. An electron beam of this kind, however, has an inhomogeneous charge density distribution. Generally, the beam will have the highest charge density in the center, and the charge density will decrease as the distance from the center, measured perpendicularly to the beam direction, increases. Consequently, in the center of the irradiated charge image, the exposure control used is more sensitive to a charge increase beyond a desired level than at the edge of the charge image. Discrimination in the detection of the charge build-up at the edge of the irradiated image with respect to the center then occurs.

The invention has for its object to provide a method which enables the exposure control to have a sensitivity which is adapted to the shadow image to be formed for the entire charge image.

To this end, a method of optimizing an exposure time of the kind set forth in accordance with the invention is characterized in that during the building up of the charge image at least part thereof is scanned frame-wise by means of an electron beam for generating the signal current. The frame-wise scanning of a charge image being built up results in the irradiation of each location of the charge image in the same manner. As soon as in a location of the charge image a charge has been built up which exceeds a threshold value adjusted by the cathode potential of the image pick-up tube, the X-ray source is switched off. As a result of this control, no shadow images can be made which are locally overexposed, notably at the edge of the shadow image. The shadow images to be made can be realized via a film camera as well as via the said image pick-up tube. A preferred method in accordance with the invention is characterized in that the cathode potential is adapted to the position of a feasible target location of the electron beam on the anode layer during the building up of the charge image. A method of this kind offers the advantage that the charge build-up can be measured with an adapted threshold for each part of the anode layer. When control of this kind is used, the exposure of the anode layer or of the film in the camera can be adapted to whatever is expected to be the subject of a shadow image. Thus, the exposure can be adapted to high-contrast and low-contrast parts of the shadow image to be realized, provided that the shadow image is roughly known in advance, which is often the case when the X-ray examining device is attended by experienced radiologists.

In order to reduce the period of time expiring between two successive scans of a point in the charge image, a method in accordance with the invention is characterized in that during the building up of the charge image use is made of a fram frequency which is higher than the frame frequency used during the reading of the charge image. A preferred embodiment of a device for using the method in accordance with the invention comprises an X-ray tube, a high voltage source, an image intensifier and an image pick-up tube and also an electronic switching and control circuit for operating the device and is characterized in that the electronic circuit can be tuned to at least two frame frequencies.

A few preferred embodiments in accordance with the invention will be described in detail hereinafter with reference to a drawing.

Figure 1:
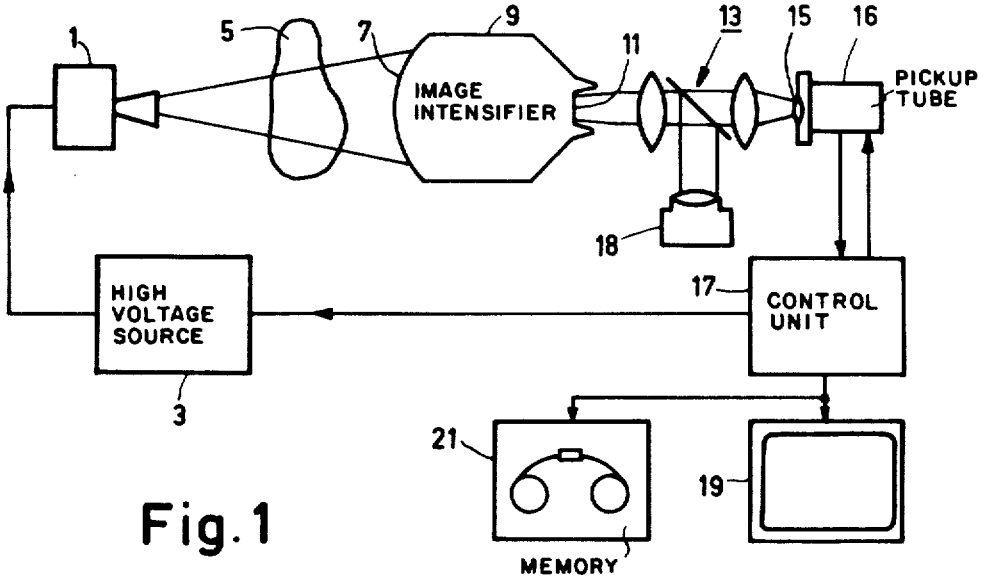
FIG. 1 is a block diagram of the device for performing a method in accordance with the invention.

The block diagram shown in FIG. 1 comprises an X-ray radiator 1 which is connected to a high-voltage source 3. The radiation produced by the X-ray radiator 1 irradiates an object 5. The radiation which has passed through the object 5 is intercepted on an input screen 7 of an image intensifier 9. An intensified luminous image of the radiation incident on the input screen 7 is formed on an output window 11. Via a system of lenses and a semi-permeable mirror 13, the image is projected onto the photosensitive layer 15 of an image pick-up tube 16 and on a film in a camera 18. The charge image which is built up in the photosensitive layer 15 is scanned by an electron beam during the building up. As soon as a signal current is generated, which is detected by a control unit 17, the control unit 17 switches off the high-voltage source 3. The charge image formed in the layer 15 is subsequently read, displayed on a monitor 19 and stored in a magnetic memory 21.

Figure 2:
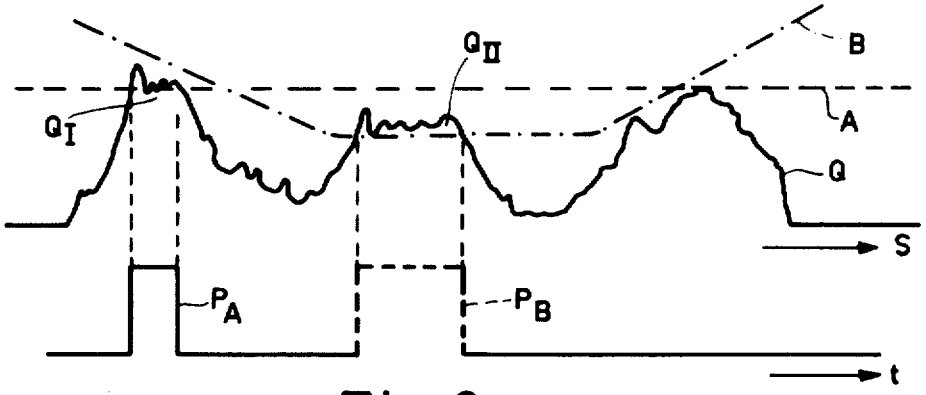
FIG. 2 shows the building up of a charge on the anode and a variation of the cathode potential adapted thereto.

The reference Q in FIG. 2 denotes the build-up of a charge on an anode layer of an image pick-up tube along a line along which an electron beam generated in the image pick-up tube scans the charge image on the anode layer. The upper horizontal axis S represents a location-dependence of the charge build-up. The lower axis shows a time function which corresponds to the time during which the electron beam scans the distance S on the anode layer. When the cathode potential is increased, the charge Q will not be removed during the scanning by the electron beam. A partial discharge (to the threshold value A) will occur only at the area where the charge Q exceeds a threshold value A which is determined by the cathode potential. The anode current then occurring is used to generate a pulse PA which terminates the exposure. In the foregoing a uniform threshold value A is used for the entire anode layer.

However, if the cathode potential is varied as a function of the position of the anode layer which is irradiated by the electron beam, the charge build-up of the various parts of the anode layer is measured with a varying threshold value. This is diagrammatically denoted by the line B in FIG. 2. Thus, underexposure of a desired important part of the shadow image to be recorded can be prevented. Underexposure of this kind will occur when an exposure is made of an object with high X-ray absorption which is situated in the vicinity of an object with low X-ray absorption. FIG. 2 shows that, rather than the first high charge peak $Q_I$, the second lower charge peak $Q_{II}$ gives rise to the generation of a switch-off pulse $P_B$.

Figure 3:
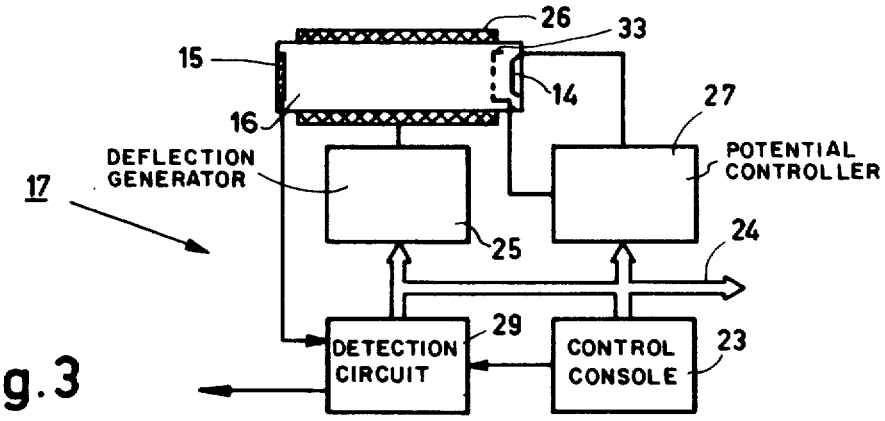
FIG. 3 is a detailed view of a unit for controlling the device shown in FIG. 1.

The essential part of the device shown in FIG. 1 is formed by the control unit 17 which will be described in detail with reference to FIG. 3. The control device 17 comprises a control console 23 for controlling the execution of an X-ray exposure and the circumstances in which an X-ray exposure is made. The control console 23 inter alia enables random control to the X-ray tube voltage and the anode current of the X-ray tube, and also of the storing of the shadow image formed in the memory 21 (not shown) and of the continuous display of the shadow image formed on the monitor 19 after an exposure has been made.

At the beginning of an exposure, after the operating of the console 23, a start signal is applied, via an information channel 24, to a high voltage source 3 (not shown). As a result of the activity of the X-radiation, a charge image will be formed on the anode 15. The start signal is also applied to a potential controller 27. The potential of the cathode 14 of the image pick-up tube 15 is increased by way of the controller 27. The increasing of the cathode potential prevents the generating of an anode current, because the electrons released from the cathode 14 cannot be incident on the anode 15, due to the increased cathode potential, for as long as at least locally insufficient charge has been built by the X-radiation. An anode current occurs as soon as a threshold value, determined by the cathode potential and adjusted on the control console 23, is exceeded. The anode current is detected by a detection circuit 29 which generates a stop signal. Via the information channel 24, this stop signal switches off the high-voltage generator 3, which means the end of the charge build-up. The stop signal also operates the potential controller 27, so that the cathode potential is decreased to the operating potential again. The electron beam is suppressed in order to prevent mutilation of the charge image built up; to this end, a suitable potential is temporarily applied to an electrode 33. After that, the charge produced on the anode 15 is read, the generated anode current then being applied, via the detection circuit 29 which comprises a video amplifier, as a video signal to a monitor 19 and a magnetic memory 21.

The charge image which is being built up during the X-ray exposure is frame-wise scanned by means of an electron beam. A deflection voltage generator 25 generates voltages whereby a deflection unit 26 is driven. As soon as the start signal, applied via the information channel 24, is received by the deflection voltage generator 25, deflection voltages are generated which have a frequency which is 10 times higher than the frequency of the deflection voltages during the reading of the charge image. As a result, the charge image is scanned 10 times more often, which results in the direct following of the charge build-up on the anode 15. When the electron beam irradiates a spot on the anode 15 which has a sufficiently large charge build-up, the deflection voltage generator 25 is returned to the normal operating condition by the detection circuit 29, via the information channel 24, after which the charge images is read.

It is possible to follow only the most relevant part of the charge build-up on the anode 15. The boundaries of the part of the anode 15 to be scanned can be adjusted on the control console 23. The deflection voltage generator 25 which generates the deflection voltages corresponding to the adjusted boundaries is controlled via the information channel 24.

What is claimed is:

1. In the method for optimizing the exposure time of an X-ray image comprising the steps of passing X-ray radiation through an object and causing charge buildup on a radiation sensitive layer of an image pickup tube therewith, irradiating said charge image with electrons from a cathode in said tube, maintaining said cathode at an increased potential with respect to an operating potential until a signal current generated by the electrons exceeds a threshold and stopping the charge buildup and reducing the cathode potential when the threshold is reached, the improvement wherein the signal current is generated by scanning at least a part of the charge image, framewise, with an electron beam during the charge buildup.

2. The method of claim 1 wherein the cathode potential varies with the position of the electron beam with respect to the charge image on the layer.

3. The method of claim 1 wherein the frame frequency of the scanning during charge buildup is higher than a frame frequency utilized for readout of the charge image.

4. The method of claim 1 wherein the line frequency of the scanning during charge buildup is higher than the line frequency utilized for readout of the charge image.

5. In apparatus comprising means for directing radiation through an object to cause buildup of a charge image on a radiation sensitive layer in an image pickup tube; means for irradiating said charge image with electrons from a cathode; and means for operating the cathode at an increased potential relative to an operating potential during the charge buildup and for stopping the charge buildup and reducing the cathode potential when a signal current generated by the electrons reaches a threshold value the improvement comprising means for scanning the charge image, framewise, during charge buildup with an electron beam which generates the signal current.

6. The apparatus of claim 5 wherein the means for scanning can be tuned to at least two different frame frequencies.

* * * * *

UNITED STATES PATENT AND TRADEMARK OFFICE

CERTIFICATE OF CORRECTION

PATENT NO. : 4,099,058

DATED : July 4, 1978

INVENTOR(S) : HANTJE REITSMA

It is certified that error appears in the above-identified patent and that said Letters Patent are hereby corrected as shown below:

Column 2, line 11, "fram" should be --frame--

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*